US005462201A

United States Patent [19]

Wilkins

[11] Patent Number: 5,462,201

[45] Date of Patent: Oct. 31, 1995

[54] AUTOMATIC LIQUID DISPENSING DEVICE

[76] Inventor: Samuel L. Wilkins, P.O. Box 108, Eastland, Tex. 76448

[21] Appl. No.: 320,667

[22] Filed: Oct. 11, 1994

[51] Int. Cl.[6] ..... B65D 35/28

[52] U.S. Cl. ..... 222/95; 222/105; 222/336; 222/472

[58] Field of Search ..... 222/95, 105, 183, 222/336, 386, 517, 325, 129, 472, 473, 474; 251/9, 10

[56] References Cited

U.S. PATENT DOCUMENTS

| | | | |
|---|---|---|---|
| 1,876,988 | 9/1932 | Lormor | 251/9 |
| 3,456,847 | 7/1969 | Scott | 222/95 |
| 4,077,544 | 3/1978 | Malacheski et al. | 222/95 |
| 4,516,693 | 5/1985 | Gaston | 251/9 X |
| 4,886,189 | 12/1989 | Vanderjagt | 222/336 X |
| 5,100,025 | 3/1992 | McGraw | 222/336 X |
| 5,316,221 | 5/1994 | Glover et al. | 222/95 X |

*Primary Examiner*—Gregory L. Huson
*Attorney, Agent, or Firm*—Michael I. Kroll

[57] ABSTRACT

An automatic dispensing device comprising a housing having an open top. A lid fits over the open top of the housing. A structure is for retaining the lid to the housing. A bag is provided with a liquid food product therein, such as ketchup or mustard. A hose on the top of the bag has a sealed end extending through one side of the lid. A facility within the housing is for compressing the bag placed therein. Paraphernalia within the lid is for releasing the liquid food product through the hose after the sealed end is removed from the hose.

8 Claims, 2 Drawing Sheets

AUTOMATIC LIQUID DISPENSING DEVICE

BACKGROUND OF THE INVENTION

1. Field of the Invention

The instant invention relates generally to liquid food product containers and more specifically it relates to an automatic dispensing device.

2. Description of the Prior Art

Numerous liquid food product containers have been provided in prior art that are adapted to hold various types of liquid food products, so that they can be portioned out therefrom. While these units may be suitable for the particular purpose to which they address, they would not be as suitable for the purposes of the present invention as heretofore described.

SUMMARY OF THE INVENTION

A primary object of the present invention is to provide an automatic dispensing device that will overcome the shortcomings of the prior art devices.

Another object is to provide an automatic dispensing device that will dispense all types of liquid food products which are stored in biodegradable plastic bags thus eliminating handling, air contamination and the need for refrigeration.

An additional object is to provide an automatic dispensing device in which a much safer food product usage is given to the general public by eliminating bacteria growth which causes contamination and spoilage by air contact.

A further object is to provide an automatic dispensing device that is simple and easy to use.

A still further object is to provide an automatic dispensing device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
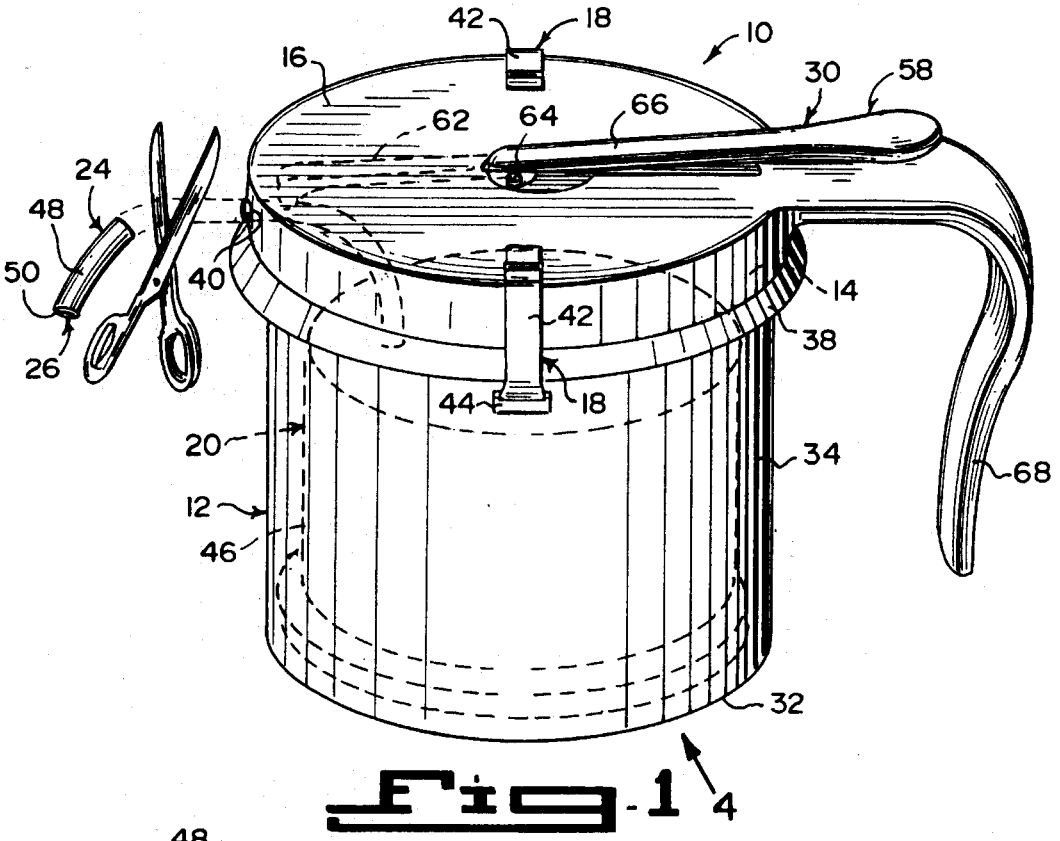
FIG. 1 is a perspective view of a first embodiment of the instant invention.
Figure 2:
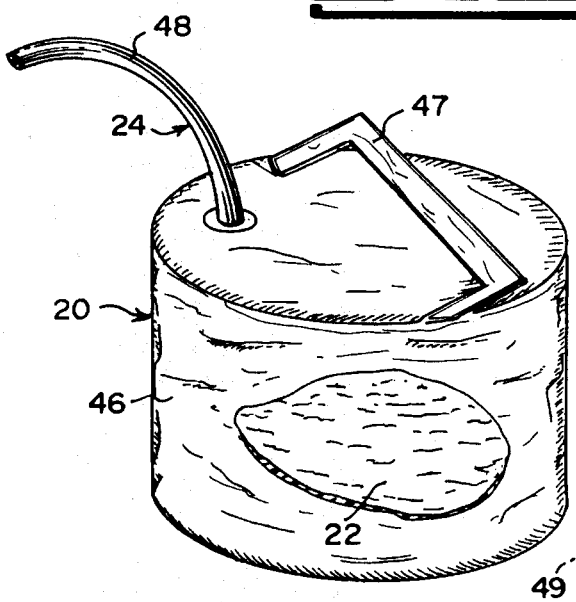
FIG. 2 is a perspective view with parts broken away of the food bag and hose.
Figure 3:
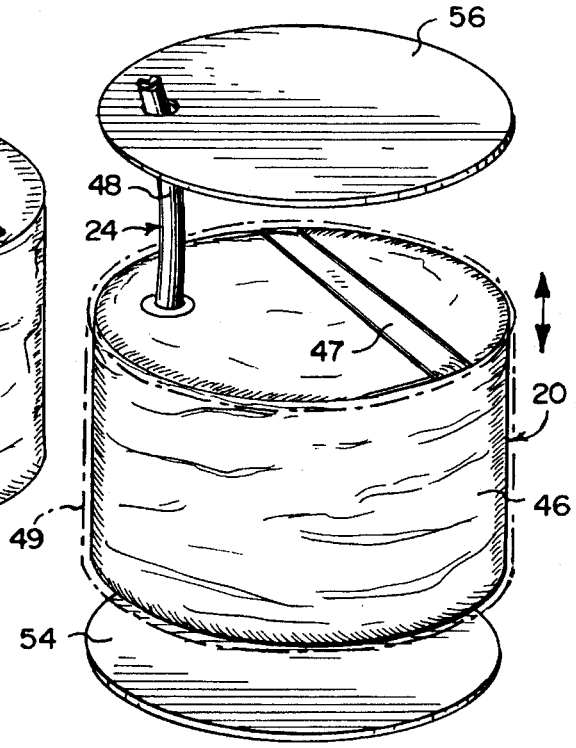
FIG. 3 is a perspective view showing an upper pressure plate and lower pressure plate being placed against the food bag and the sleeve in phantom before insertion into the housing.
Figure 4:
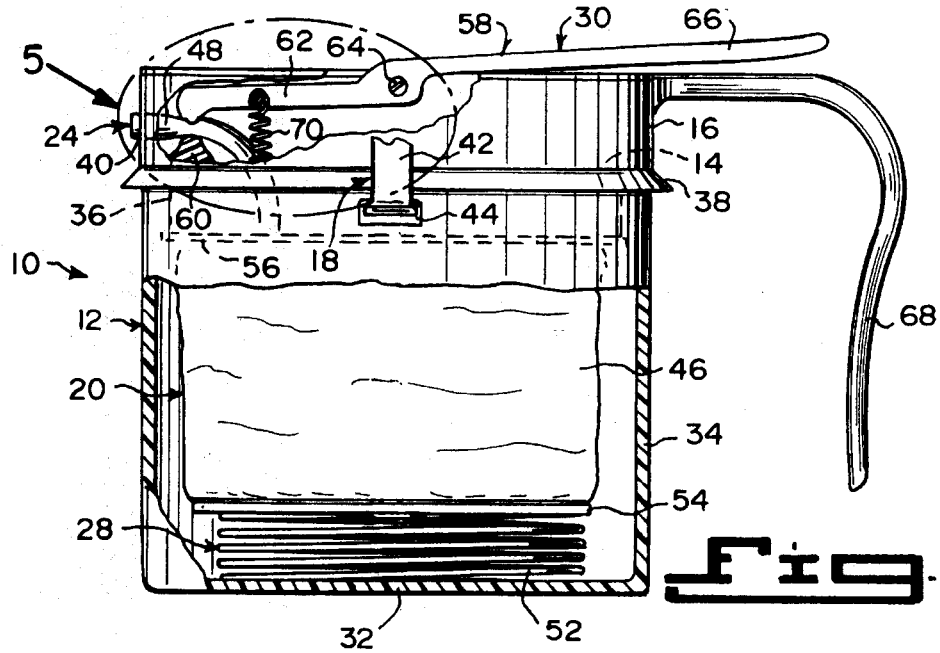
FIG. 4 is a front view of the first embodiment taken in the direction of arrow 4 in FIG. 1 with parts broken away and in section.

Turning now descriptively to the drawings, in which similar reference characters denote similar elements throughout the several views, FIGS. 1 and 4 illustrate an automatic dispensing device 10 comprising a housing 12 having an open top 14. A lid 16 fits over the open top 14 of the housing 12. A structure 18 is for retaining the lid 16 to the housing 12. A bag 20, as best seen in FIGS. 2 and 3 is provided with a liquid food product 22 therein, such as ketchup or mustard. A hose 24 on the top of the bag 20 has a sealed end 26 extending through one side of the lid 16. A facility 28 within the housing 12 is for compressing the bag 20 placed therein. Paraphernalia 30 within the lid 16 is for releasing the liquid food product 22 through the hose 24 after the sealed end 26 is removed from the hose 24.

The housing 12 is cylindrical shaped having a bottom wall 32 and an upstanding hollow body 34. The lid 16 is cylindrical shaped having a downwardly extending collar 36 to fit into the open top 14 of the housing 12. A flared out lip 38 sits upon the hollow body 34 and a side aperture 40 is for exiting the hose 24.

The retaining structure 18 is a pair of clamps 42 extending between the lid 16 and opposite sides 44 of the hollow body 34 of the housing 12. The bag 20 is a cylindrical shaped collapsible plastic barrel-shaped sack 46. A carry handle 47 is on top of the collapsible plastic barrel-shaped sack 46. A sleeve 49, shown in phantom in FIG. 3, is sized to slide over the collapsible plastic barrel-shaped sack 46, so as to fit into the follow body 24 of the housing 12 and then the sleeve 49 can be removed therefrom. The hose 24 is an elongate flexible tube 48 having a plug seal 50 at its distal free end.

The compressing facility 28 includes a compression spring 52 placed onto the bottom wall 32 within the hollow body 34 of the housing 12. A lower pressure plate 54 is placed between the top of the compression spring 52 and the bottom of the collapsible plastic barrel-shaped sack 46. An upper pressure plate 56 is placed between the top of the collapsible plastic barrel-shaped sack 46 and the collar 36 of the lid 16. When the clamps 42 are engaged to hold the lid 16 to the housing 12, the spring 52 will be compressed to cause the collapsible plastic barrel-shaped sack 46 to be squeezed forcing the liquid food product 24 up through the flexible tube 48.

Figure 5:
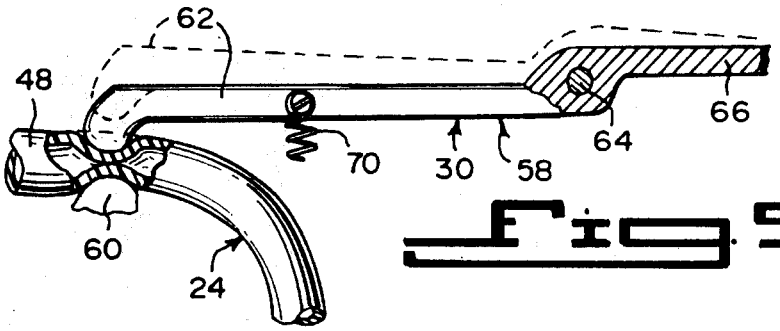
FIG. 5 is an enlarged view of a portion of the hose sealing member as indicated by arrow 5 in FIG. 4.

The liquid food product releasing paraphernalia 30 is a grasping mechanism 58 built into the lid 16 which pinches the tube 48 to prevent the liquid food product 24 to exit therefrom until the grasping mechanism 58 is manually operated to disengage with the tube 48. The grasping mechanism 58, as best seen in FIG. 5, consists of a stationary Jaw 60 in the lid 16 adjacent the side aperture 40. A moveable jaw 62 is pivotable at 64 in the lid 16 and adjacent the side aperture 40. A lever arm 66 is on the moveable jaw 62 and extends upwardly at a slight angle out from the lid 16, so as to operate the moveable jaw 62. A handle 68 on the lid 16 is directly under the lever arm 66. A return spring 70 extends between the moveable jaw 62 and the lid 16, so that the moveable Jaw 62 will normally pinch the tube 48 against the stationary Jaw 60, until the lever arm 66 is manually pressed downwardly towards the handle 68, to lift the moveable jaw 62 away from the stationary Jaw 60.

Figure 6:
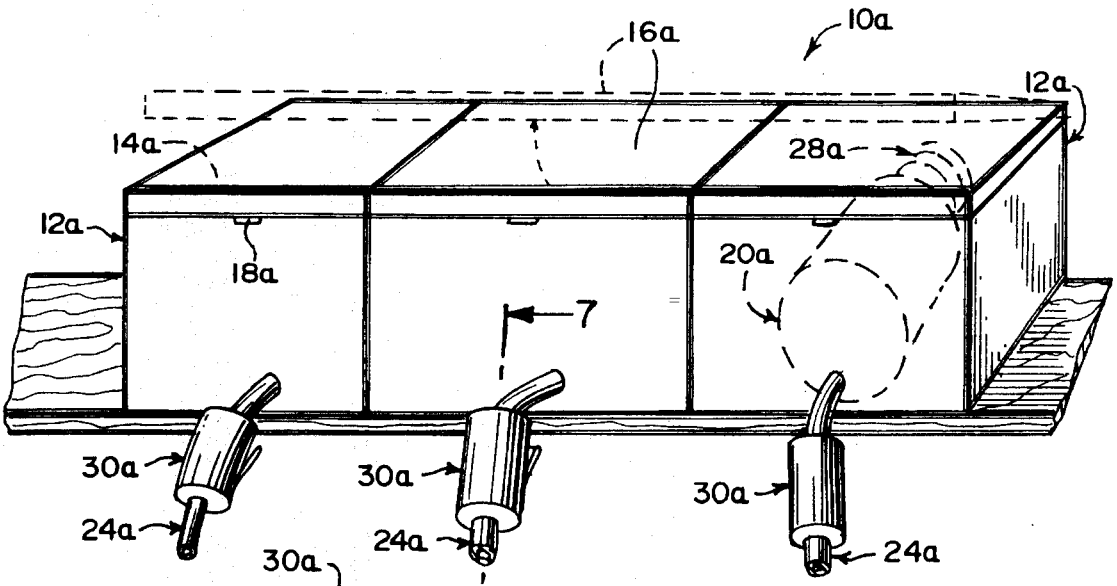
FIG. 6 is a perspective view of a second embodiment of the instant invention.
Figure 7:
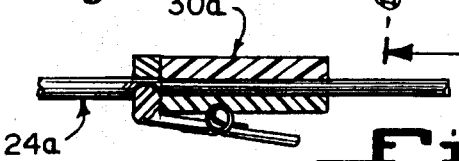
FIG. 7 is a cross sectional view of one of the hose sealing members taken along line 7—7 in FIG. 6.

An alternate automatic dispensing device **10*a* is shown in FIG. 6 and comprises a plurality of box-shaped housings 12*a* in side by side relationships, each having an open top 14*a*. A plurality of lids 16*a* are provided, with each hinged to one housing 12*a* to cover the open top 14*a*. A plurality of latch mechanisms 18***a* are also provided, with each to retain each lid 16*a* to each housing 12*a*. A plurality of bags 20*a* are also provided, with a liquid food product 22 within each bag 20*a*. A plurality of hoses 24*a* are also provided, with each connected to each bag 20*a* having a sealed end (not shown) extending through a front side of each housing 12*a*. A facility 28*a* is within each housing 12*a*, for compressing each bag 20*a* placed therein. Paraphernalia 30*a* on each hose 24*a* and shown in FIGS. 6 and 7, is for releasing the liquid food product 22 through the hose 24*a* after the sealed end is removed from the hose 24*a*.

LIST OF REFERENCE NUMBERS

10 automatic dispensing device
10*a* alternate automatic dispensing device
12 housing for 10
12*a* box-shaped housing for 10*a*
14 open top of 12
14*a* open top of 12*a*
16 lid for 12
16*a* lid for 12*a*
18 retaining structure between 12 and 16
18*a* latch mechanism between 12*a* and 16*a*
20 bag in 12
20*a* bag in 12*a*
22 liquid food product in 20 and 20*a*
24 hose for 20
24*a* hose for 20*a*
26 sealed end of 24
28 compression facility in 12
28*a* compressing facility in 12*a*
30 liquid food product releasing paraphernalia
30*a* liquid food product releasing paraphernalia
32 bottom wall of 12
34 upstanding hollow body of 12
36 downwardly extending collar on 16
38 flared out lip on 16
40 side aperture in 16
42 clamp on 16
44 side of 34
46 collapsible plastic barrel-shaped sack for 20
47 carry handle on 46
48 flexible tube for 24
49 sleeve
50 plug seal for 26
52 compression spring
54 lower pressure plate
56 upper pressure plate
58 grasping mechanism for 30
60 stationary jaw
62 moveable jaw
64 pivot
66 lever arm on 62
68 handle on 16
70 return spring It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An automatic dispensing device comprising:

a) a housing having an open top, said housing being cylindrical shaped having bottom wall and an upstanding hollow body;

b) a lid to fit over said open top of said housing, said lid being cylindrical shaped having a downwardly extending collar to fit into said open top of said housing, a flared out lip to sit upon said hollow body and a side aperture for exiting said hose;

c) means for retaining said lid to said housing;

d) a bag with a liquid food product therein;

e) a hose on the top of said bag having a sealed end extending through one side of said lid;

f) means within said housing for compressing said bag placed therein; and g) means within said lid for releasing the liquid food product through said hose after said sealed end is removed from said hose.

2. An automatic dispensing device as recited in claim 1, wherein said retaining means is a pair of clamps extending between said lid and opposite sides of said hollow body of said housing.

3. An automatic dispensing device as recited in claim 2, wherein said bag includes:

a) a cylindrical shaped collapsible plastic barrel-shaped sack; and b) a carry handle on top of said collapsible plastic barrel-shaped sack.

4. An automatic dispensing device as recited in claim 3, further including a sleeve sized to slide over said collapsible plastic barrel-shaped sack, so as to fit into said hollow body of said housing and then said sleeve can be removed therefrom.

5. An automatic dispensing device as recited in claim 4, wherein said hose is an elongate flexible tube having a plug seal at its distal free end.

6. An automatic dispensing device as recited in claim 5, wherein said compressing means includes:

a) a spring placed onto said bottom wall within said hollow body of said housing;

b) a lower pressure plate placed between the top of said compression spring and the bottom of said collapsible plastic barrel-shaped sack; and c) an upper pressure plate placed between the top of said collapsible plastic barrel-shaped sack and said collar of said lid, so that when said clamps are engaged to hold said lid to said housing, said spring will be compressed to cause said collapsible plastic barrel-shaped sack to be squeezed forcing the liquid food product up through said flexible tube.

7. An automatic dispensing device as recited in claim 6, wherein said liquid food product releasing means is a grasping mechanism built into said lid which pinches said tube to prevent the liquid food product to exit therefrom until said grasping mechanism is manually operated to disengage with said tube.

8. An automatic dispensing device as recited in claim 7, wherein said grasping mechanism includes:

a) a stationary jaw in said lid adjacent said side aperture;

b) a moveable jaw pivotable in said lid and adjacent said side aperture;

c) a lever arm on said moveable jaw and extending upwardly at a slight angle out from said lid, so as to operate said moveable jaw;

d) a handle on said lid directly under said lever arm; and e) a return spring extending between said moveable jaw and said lid, so that said moveable jaw will normally pinch said tube against said stationary jaw, until said lever arm is manually pressed downwardly towards said handle to lift said moveable jaw away from said stationary jaw.

* * * * *